US010907527B2

(12) United States Patent
Sarder et al.

(10) Patent No.: US 10,907,527 B2
(45) Date of Patent: Feb. 2, 2021

(54) STANDBY GENERATOR ALTERNATOR ADAPTER WITH ENGINE COOLING AIR INTAKE

(71) Applicant: Champion Power Equipment, Inc., Santa Fe Springs, CA (US)

(72) Inventors: Mark J. Sarder, Waukesha, WI (US); Russell J. Dopke, Elkhart Lake, WI (US); Hiroaki Sato, Brookfield, WI (US); Leigh A. Jenison, Hartland, WI (US)

(73) Assignee: Champion Power Equipment, Inc., Sante Fe Springs, CA (US)

( * ) Notice: Subject to any disclaimer, the term of this patent is extended or adjusted under 35 U.S.C. 154(b) by 0 days.

(21) Appl. No.: 16/398,541

(22) Filed: Apr. 30, 2019

(65) Prior Publication Data

US 2019/0376437 A1 Dec. 12, 2019

Related U.S. Application Data

(60) Provisional application No. 62/681,157, filed on Jun. 6, 2018.

(51) Int. Cl.

| | |
|---|---|
| ***F01P 1/00*** | (2006.01) |
| ***F02B 63/04*** | (2006.01) |
| ***F01P 5/04*** | (2006.01) |
| ***F02B 63/00*** | (2006.01) |
| *F02B 75/18* | (2006.01) |
| *F02B 75/22* | (2006.01) |

(52) U.S. Cl.

CPC ..... *F01P 1/00* (2013.01); *F01P 5/04* (2013.01); *F02B 63/00* (2013.01); *F02B 63/04* (2013.01); *F02B 63/044* (2013.01); *F02B 75/22* (2013.01); *F02B 2075/1808* (2013.01)

(58) Field of Classification Search

CPC ..... F01P 1/00; F01P 5/04; F02B 75/22; F02B 2075/1808; F02B 63/04; F02B 63/044; F02B 63/00

See application file for complete search history.

(56) References Cited

U.S. PATENT DOCUMENTS

| | | | | |
|---|---|---|---|---|
| 4,608,946 A | | 9/1986 | Tanaka et al. | |
| 4,677,940 A | * | 7/1987 | Bracht | F01P 1/00 123/2 |

(Continued)

FOREIGN PATENT DOCUMENTS

| | | |
|---|---|---|
| CN | 1800600 A | 7/2006 |
| CN | 2890369 Y | 4/2007 |

(Continued)

*Primary Examiner* — Syed O Hasan

(74) *Attorney, Agent, or Firm* — Ziolkowski Patent Solutions Group, SC

(57) ABSTRACT

An alternator adapter for a generator engine includes a main body defining an airflow chamber. The main body includes an airflow outlet in a first end of the main body, an engine shaft opening in a second end of the main body opposite the first end, and an airflow inlet between the first end and the second end. The alternator adaptor also includes an engine mount coupled to the first end of the main body around the airflow outlet and aligned with the engine shaft opening, and an alternator mount coupled to the second end of the main body around the engine shaft opening.

21 Claims, 6 Drawing Sheets

(56) References Cited

U.S. PATENT DOCUMENTS

| | | | | |
|---|---|---|---|---|
| 4,702,201 | A | 10/1987 | Odo et al. | |
| 5,899,174 | A | 5/1999 | Anderson et al. | |
| 6,028,369 | A | 2/2000 | Hirose et al. | |
| 6,119,636 | A * | 9/2000 | Fan | F02B 63/04 123/2 |
| 6,331,740 | B1 | 12/2001 | Morohoshi et al. | |
| 6,376,944 | B1 | 4/2002 | Grizzle, Jr. et al. | |
| 6,489,690 | B1 | 12/2002 | Hatsugai et al. | |
| 6,784,574 | B2 * | 8/2004 | Turner | F02B 43/00 310/58 |
| 6,825,573 | B2 | 11/2004 | Suzuki et al. | |
| 6,975,042 | B2 | 12/2005 | Yamada et al. | |
| 7,067,947 | B2 * | 6/2006 | Ihata | H02K 11/046 310/60 R |
| 7,537,070 | B2 | 5/2009 | Maslov et al. | |
| 7,642,665 | B2 | 1/2010 | Konop et al. | |
| 8,899,191 | B2 | 12/2014 | Yano et al. | |
| 9,181,865 | B2 * | 11/2015 | Richardson | F02B 63/04 |
| 9,617,951 | B2 | 4/2017 | Sotiriades et al. | |
| 2002/0000342 | A1 | 1/2002 | Yamada et al. | |
| 2002/0149203 | A1 * | 10/2002 | Suzuki | F02B 63/04 290/1 A |
| 2013/0187392 | A1 | 7/2013 | Janscha et al. | |
| 2016/0233739 | A1 | 8/2016 | Jenison et al. | |
| 2016/0294255 | A1 | 10/2016 | Schmit et al. | |
| 2016/0319728 | A1 | 11/2016 | Jenison et al. | |

FOREIGN PATENT DOCUMENTS

| | | | |
|---|---|---|---|
| CN | 204024810 | U | 12/2014 |
| CN | 104314676 | A | 1/2015 |

* cited by examiner

STANDBY GENERATOR ALTERNATOR ADAPTER WITH ENGINE COOLING AIR INTAKE

CROSS-REFERENCE TO RELATED APPLICATION

The present application is a non-provisional of, and claims priority to, U.S. Provisional Patent Application Ser. No. 62/681,157, filed Jun. 6, 2018, the disclosure of which is incorporated herein by reference in its entirety.

BACKGROUND OF THE INVENTION

Embodiments of the invention relate generally to standby generators and, more particularly, to an alternator adapter for use in a standby generator.

Engine-driven, electrical generators are used in a wide variety of applications. Typically, an electrical generator utilizes a single driving engine directly coupled to a generator or alternator through a common shaft. Upon activation of the generator, a fuel and air mixture is provided to the combustion chambers of corresponding cylinders of the engine. The fuel mixture in each combustion chamber is ignited, thereby causing an explosion within the cylinders. The explosive forces within the combustion chambers in the cylinders cause linear motion of the pistons within their corresponding cylinders. This linear motion of the pistons is then converted into rotational motion by a crankshaft that, in turn, drives the alternator. As is conventional, the driven alternator generates electrical power.

Engine driven, electrical generators often use an air-cooled engine to drive the generator or alternator. The air-cooled engine can have an engine cooling fan coupled to the crankshaft, that in turn drives cooling air over cylinders of the engine. Engine driven, electrical generators can utilize a coupling means to mount the alternator to the engine and align the crankshaft to the alternator. The alternator is typically driven by the crankshaft while positioned on a downstream side of the engine from the engine cooling fan. Unfortunately, in this arrangement, hot air expelled from cooling the engine can be blown over the generator or alternator causing operation at higher and less efficient temperatures.

Therefore, it would be desirable to provide an electrical generator that provides for positioning of the alternator at a location other than the downstream side of the engine from the engine cooling fan, with an alternator adapter being provided that allows for such positioning of the alternator relative to the engine and engine fan. It would be further desirable for the alternator adapter to mount the alternator to the engine and align the crankshaft to the alternator at a location upstream from the engine cooling fan, while also facilitating airflow through the adapter to the engine cooling fan in a direction opposite the alternator.

BRIEF DESCRIPTION OF THE INVENTION

Embodiments of the invention are directed to an alternator adaptor for an air-cooled engine that facilitates cooling airflow through the adaptor and to the engine.

In accordance with one aspect of the invention, an alternator adapter for a generator engine includes a main body defining an airflow chamber. The main body includes an airflow outlet in a first end of the main body, an engine shaft opening in a second end of the main body opposite the first end, and an airflow inlet between the first end and the second end. The alternator adaptor also includes an engine mount coupled to the first end of the main body around the airflow outlet and aligned with the engine shaft opening, and an alternator mount coupled to the second end of the main body around the engine shaft opening.

In accordance with another aspect of the invention, an engine-generator set includes a coupling for a generator having an engine mount comprising an airflow opening, a generator mount, and a spacer section holding the engine mount aligned with the generator mount in a spaced relationship allowing airflow into the coupling and to the airflow opening. The engine-generator set also includes an air-cooled engine coupled to the engine mount with a crankshaft extending through the airflow opening and an engine fan coupled to the crankshaft on a side of the air-cooled engine facing the coupling. The engine-generator set further includes a generator coupled to the generator mount and driven by the crankshaft.

In accordance with yet another aspect of the invention, an alternator adapter for an air-cooled engine includes an engine mount having a cooling air opening formed therein, a generator mount, and a frame having an outer casing holding the engine mount aligned with the generator mount. The outer casing includes an airflow inlet fluidically connected to the cooling air opening to allow flow of engine cooling air through the adapter.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION OF THE PREFERRED EMBODIMENTS

The operating environment of the invention is described with respect to a standby generator. However, those skilled in the art will appreciate that the invention is equally applicable for use with portable or other electrical generators. While the invention will be described with respect to an engine-generator set having an airflow arrangement in a generator enclosure, embodiments of the invention are equally applicable for use with engine-generator sets that are not housed in a generator enclosure.

Figure 1:
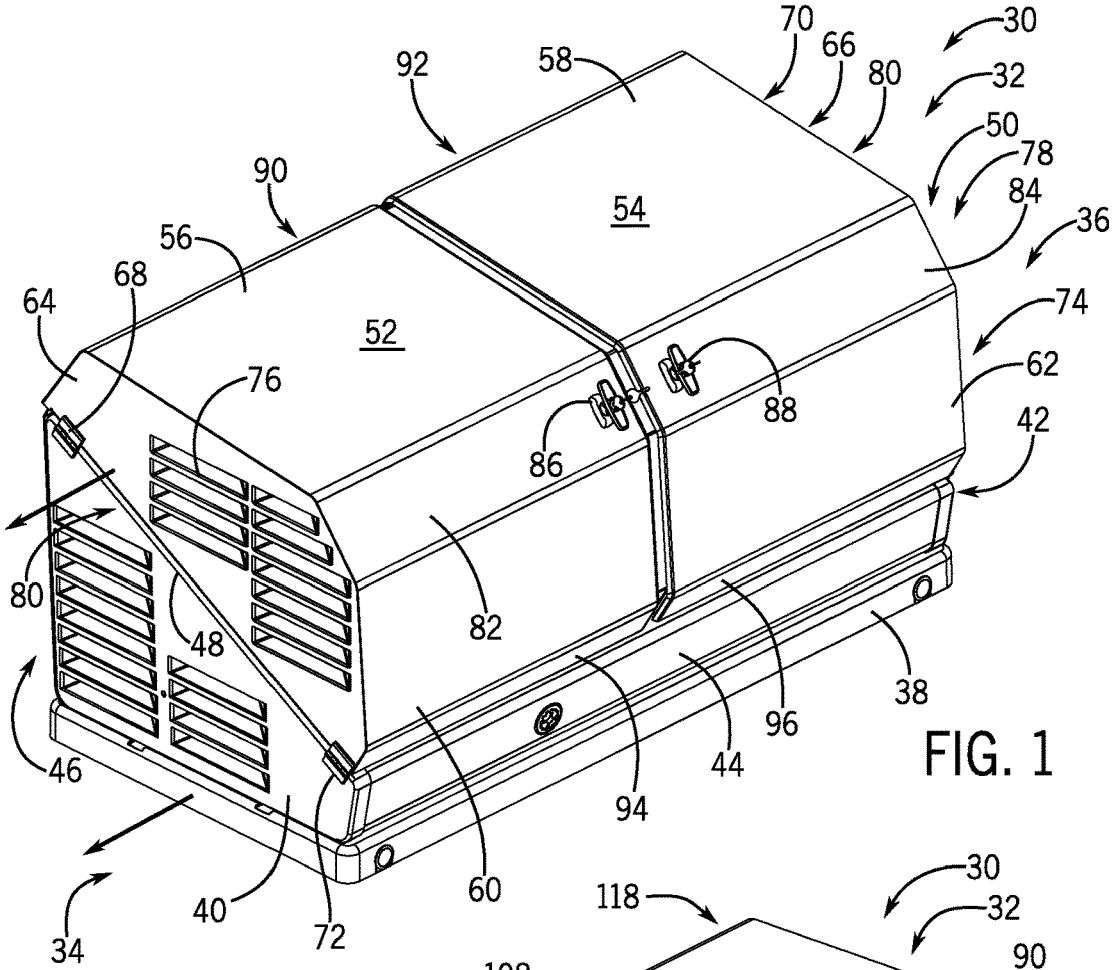
FIG. 1 is a perspective view from the left upper side of an electrical generator, according to an embodiment of the invention.

Referring to FIG. 1, a standby generator 30 is shown, in accordance with an embodiment of the invention. The standby generator 30 produces electrical energy and may deliver the electrical energy to a distribution panel of a home, office, shop, business or any other building requiring electricity. The standby generator 30 may include an internal combustion engine, an alternator driven by the internal combustion engine, and other associated components. The internal combustion engine operates on a fuel source that may include gasoline, diesel, liquefied petroleum gas (LPG), propane, butane, natural gas, or any other fuel source suitable for operating the engine. For instance, the internal combustion engine may comprise a single fuel engine configured to operate on one of the fuels. Alternatively, the engine may comprise a dual fuel or multi-fuel engine configured to switch operation between two or more of the fuel sources. For example, the engine may comprise a dual fuel engine configured to switch operation between LPG and gasoline, or LPG and diesel. The alternator and engine may form an engine-generator set used to produce electricity for distribution from the standby generator 30.

The standby generator 30 may include a standby generator enclosure or housing 32 to house the engine-generator set and other associated components. In the embodiment of FIG. 1, the engine-generator set is positioned in a horizontal crankshaft arrangement with the engine located toward a first end 34 of the enclosure 32 and the alternator located toward a second end 36 of the enclosure 32. The standby generator enclosure 32 may include a base 38 to support the engine-generator set. The enclosure 32 may also have a first sidewall 40 and a second sidewall 42 each extending generally vertically from opposite ends of the base 38 at the first end 34 and the second end 36 of the enclosure 32, respectively. The enclosure 32 may also include a front wall 44 and a back wall 46 extending generally vertically from the base 38 between the first sidewall 40 and the second sidewall 42, with the front wall 44 and the back wall 46 defining a front and a back sidewall of the standby generator 30. The front wall 44 and the back wall 46 may be angled slightly from vertical such that each has a bottom portion positioned slightly inward from a corresponding top portion. The first sidewall 40 and the second sidewall 42 may each have a respective top edge 48, 50 that generally slopes diagonally from a taller back wall 46 to a shorter front wall 44.

The enclosure 32 may also include one or more hoods to cover the standby generator 30. The embodiment shown in FIG. 1 has a first hood 52 and a second hood 54, also referred to as doors, coupled to a respective first sidewall 40 and second sidewall 42. The first hood 52 and the second hood 54 may each have a top panel 56, 58, a front panel 60, 62, and a side panel 64, 66 with the side panels generally perpendicular to the respective top and front panels. The side panels 64, 66 of each hood 52, 54 may each be coupled to a respective one of the first sidewall 40 and the second sidewall 42 of the enclosure 32 using a first hinge 68, 70 and a second hinge 72, 74, with the first hinges near the back of the enclosure 32 and the second hinges near the front of the enclosure 32. The first hood 52 may be hinged to the enclosure 32 to rotate over a top of the first sidewall 40 and the second hood 54 may be hinged to the enclosure 32 to rotate over a top of the second sidewall 42. The first hood 52 and the second hood 54 may rotate about an upper or top edge 48, 50 of each respective sidewall 40, 42 beyond the first end 34 and the second end 36 of the enclosure 32 in a "gull wing" configuration for ease of access and serviceability to the generator 30 through the front of the enclosure. The "gull wing" configuration may allow the first hood 52 and the second hood 54 to open without contacting a home, office, shop, business, or any other building requiring electricity located behind the standby generator 30.

The first hood 52 and the second hood 54 may open outwards beyond the respective first sidewall 40 and second sidewall 42 to expose a top and front entrance into the enclosure 32. The front wall 44 may be relatively short compared to the overall height of the enclosure 32 in part to allow for improved front access into the enclosure 32 when the hoods 52, 54 are open. The back wall 46 may be relatively tall compared to the front wall 44 with the first sidewall 40 and the second sidewall 42 having a forward sloping top edge 48, 50 from the back wall 46 to the front wall 44. The first hood 52 and the second hood 54 can then open upward and slightly forward as they rotate along the forward sloping top edge 48, 50 of each respective sidewall 40, 42. In other embodiments, the first hood 52 and the second hood 54 may rotate about a horizontal or vertical edge of a respective first sidewall 40 and second sidewall 42 between opened and closed positions.

As shown in FIG. 1, the side panels 64, 66 may include vents 76, 78 with louvers, and vents may be formed in the first sidewall 40 and the second sidewall 42. The vents 76, 78 may provide one or more airflow openings 80 in the standby generator enclosure 32. The top panels 56, 58 are preferably sloped downward toward the front of the enclosure 32 and the front panels 60, 62 may slope forward toward the base 38 of the enclosure 32 to enhance water runoff. Each hood 52, 54 may also have a front transition panel 82, 84 between the respective top panel 56, 58 and the front panel 60, 62. The front transition panels 82, 84 further encourage water runoff and add to an aesthetically pleasing design. A handle 86, 88 may be attached to the front transition panel 82, 84 of each hood 52, 54 for opening the hoods and exposing internal components of the standby generator 30. The front transition panels 82, 84 are designed so the handles 86, 88 enhance accessibility by directionally facing a person standing in front of the enclosure 32 when the hoods 52, 54 are closed. Each hood 52, 54 may also have a rear transition panel 90, 92 that slopes downward from the respective top panel 56, 58 toward the back wall 46 when the hoods are closed. Each hood 52, 54 may also have a lower transition panel 94, 96 that slopes inward from the respective front panel 60, 62 toward the front wall 44 when the hoods are closed. The rear transition panels 90, 92 and the lower transition panels 94, 96 further encourage water runoff and add to an aesthetically pleasing design.

Figure 2:
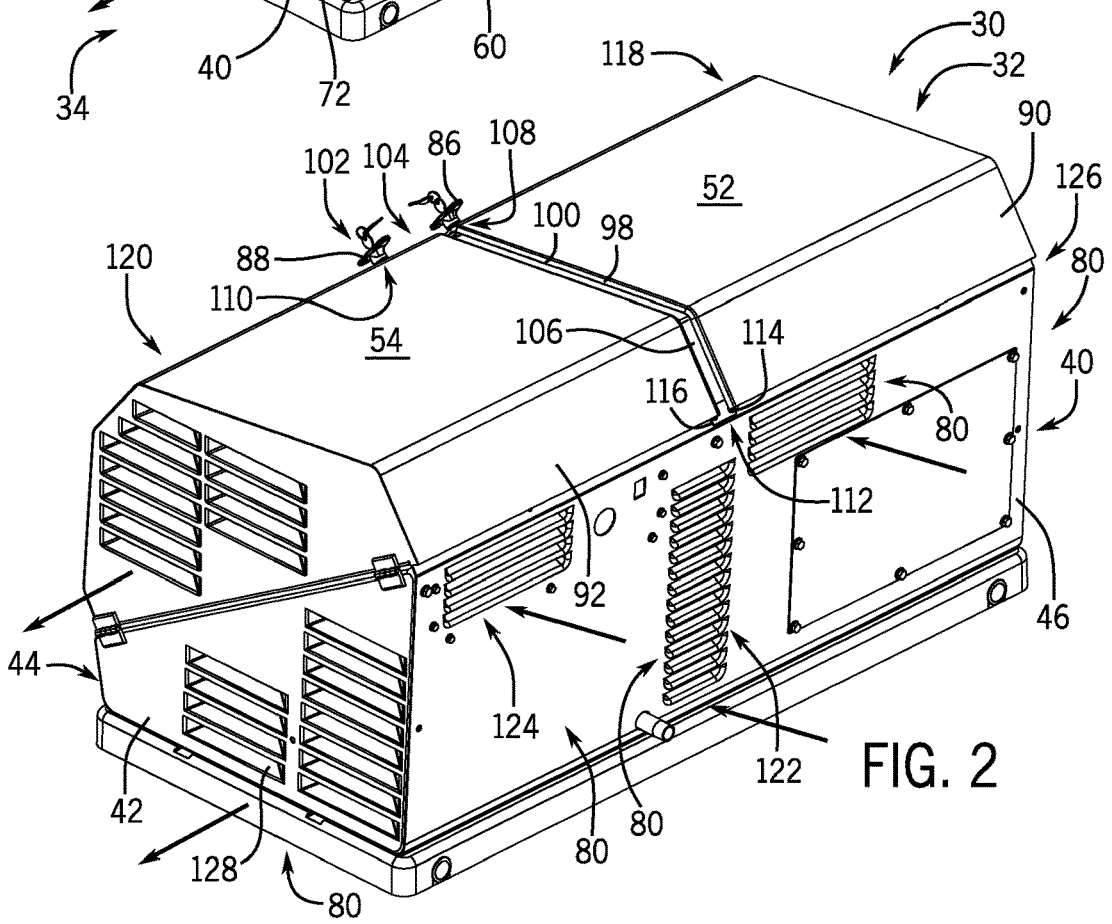
FIG. 2 is a rear perspective view from the right upper side of the electrical generator of FIG. 1, according to an embodiment of the invention.

Referring now to FIG. 2, a standby generator 30 with one or more airflow inlets in a backwall of the generator enclosure 32 is shown, in accordance with an embodiment of the invention. FIG. 2 shows a support arm 98 extending across a center of the enclosure 32 to support the first hood 52 and the second hood 54 in the closed position. The support arm 98 extends from the back wall 46 over an interior of the enclosure 32 to the front wall 44. The support arm 98 may have a geometry that matches the first hood 52 and the second hood 54 to ensure the hoods close tightly against the support arm. Accordingly, the support arm 98 may have a top panel 100, a front panel 102, a front transition panel 104, and a rear transition panel 106 to match the first hood 52 and the second hood 54. The support arm 98 may also receive a latch 108, 110 from each handle 86, 88 to hold the first hood 52 and the second hood 54 closed.

The support arm 98 preferably has a channel or gutter 112 extending the length of the support arm to channel water off the front and back of the enclosure 32. The gutter 112 may be formed by raised outer edges that include a first rain seal 114 and a second rain seal 116 on opposite sides of the support arm 98. The first rain seal 114 and the second rain seal 116 each support and seal a respective hood 52, 54 in the closed position. The first rain seal 114 and the second rain seal 116 may also extend across portions of the back wall 46, front wall 44, and respective first and second sidewalls 40, 42 to seal around each perimeter entrance covered by the hoods 52, 54. The rain seals 114, 116 prevent rain from entering the enclosure 32 and may make the enclosure rain tight. Although some water may enter the enclosure 32 without negatively affecting the generator 30, it is desirable to prevent water from entering the electrical areas within the enclosure 32. The rain seals 114, 116 may make the electrical areas within the enclosure 32 rain tight.

According to an exemplary embodiment of the invention, the standby generator 30 has an enclosure 32 with multiple chambers to separate components and one or more airflow inlets in a backwall of the generator enclosure 32, so as to manage heat transfer in the enclosure 32. The multi-chamber generator enclosure 32 may include at least a first chamber 118 and a second chamber 120 each comprising an air inlet 122, 124 and an air outlet 126, 128. The air inlet 122 of the first chamber 118 and the air inlet 124 of the second chamber 120 are shown as airflow openings 80 in the back wall 46 of the multi-chamber generator enclosure 32. The air outlet 126 of the first chamber 118 and the air outlet 128 of the second chamber 120 are shown as airflow openings 80 in opposite end walls 40, 42 of the multi-chamber generator enclosure 32 between the front wall 44 and the back wall 46. Rear transition panels 90, 92, 106 may extend over the air inlets 122, 124 to direct rain off the enclosure away from the inlets.

Figure 3:
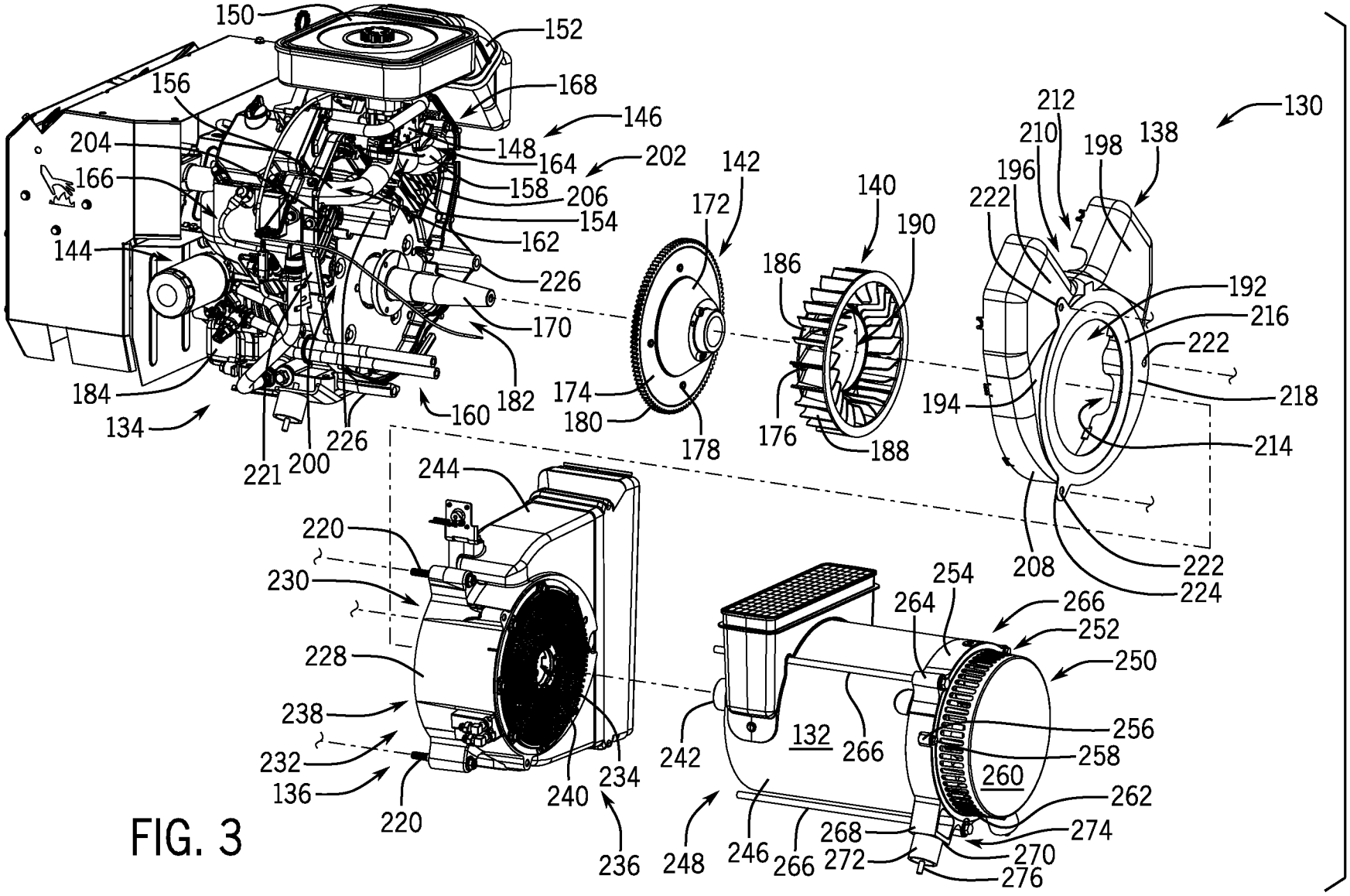
FIG. 3 is a perspective view showing components of the electrical generator of FIG. 1 from the right upper side of an engine having a muffler positioned in a muffler box with components of the electrical generator exploded from the engine, according to an embodiment of the invention.

Referring now to FIG. 3, an engine-generator set 130 is shown with an alternator 132 and additional generator components exploded from an engine 134, according to an embodiment of the invention. FIG. 3 shows an alternator adapter 136, a fan cover 138, an engine cooling fan 140, and a fan base 142 exploded from the engine 134. The engine 134 may comprise a v-twin engine having two cylinders 144, 146. FIG. 3 shows an embodiment of the engine 134 having a fuel and air mixer 148 coupled between the cylinders 144, 146 on a top portion of the engine 134. The fuel and air mixer 148 may couple to air filter 150 that receives air from a combustion intake air duct 152. The fuel and air mixer 148 combines air with gaseous fuel and supplies the combination to the cylinders 144, 146. The fuel and air mixer 148 couples to an intake manifold 154 having an intake pipe 156, 158 for each cylinder. The intake pipes 156, 158 cross a front side 160 of the engine 134 to intake ports 162, 164 of a respective cylinder head 166, 168. The fuel and air mixer 148 may be used instead of a carburetor for engines configured to operate on gaseous fuel, for instance LPG, propane, or natural gas.

To support the engine cooling fan 140 on the engine 134, fan base 142 may be mounted on crankshaft 170 of the engine. The fan base 142 may include a domed shape component 172. The fan base 142 may also include a circular plate 174 mounted to the domed shape component 172 to receive the engine cooling fan 140 mounted thereon with a plurality of fasteners 176 that extend through openings 178 in the circular plate 174. A ring gear 180 can also couple to an outer radius of the circular plate 174, the ring gear 180 having gear teeth driven by a starter motor 182 coupled to the crankcase 184. The engine cooling fan 140 may include an annular disc 186 with a plurality of fan blades 188 extending from one side of the annular disc. The fan blades 188 are shown extending from a center opening 190 to a perimeter of the annular disc 186. The annular disc 186 may include openings for the fasteners 176 to mount the engine cooling fan 140 to the fan base 142, which may comprise a plurality of bolts. The crankshaft 170 can be inserted through the center opening 190 in the annular disc 186 such that the fasteners 176 can secure the engine cooling fan 140 to the fan base 142.

FIG. 3 also shows a fan cover 138 that mounts over the engine cooling fan 140 between the engine 134 and the alternator adapter 136. That is, the fan cover 138 may be mounted over a front side 160 of the engine 134 and preferably has an airflow opening 192 surrounding the crankshaft 170 of the engine. The fan cover 138 can include a main section 194 covering the engine cooling fan 140, and a first arm 196 and a second arm 198 each extending from the main section to cover a front side 160 of a respective cylinder 144, 146. For instance, the fan cover 138 may be mounted over the engine cooling fan 140 and over sides of two cylinder blocks 200, 202 and sides of two cylinder heads 166, 168 of the cylinders 144, 146. The cylinder blocks 200, 202 and corresponding cylinder heads 166, 168 each may comprise a plurality of cooling fins 204, 206. The engine cooling fan 140 can draw air through the airflow opening 192 in the main section 194 of the fan cover 138 and drive the air through the two arms 196, 198 of the cover to each respective cylinder 144, 146.

The fan cover 138 may include side portions 208 extending around the main section 194 and both arms 196, 198. The side portions 208 extend generally perpendicular to the main section 194 and the arms 196, 198, with rounded corners connecting the side portions 208 to the main section 194 and the arms 196, 198. The side portions 208 may also have a first and a second cutout 210, 212 that fit over the intake pipes 156, 158, and a third cutout 214 that fits over the starter motor 182. The fan cover 138 may include an alternator adapter mounting surface 216 that mates to the alternator adapter 136, with an adapter support plate 218 preferably mounted to the alternator adapter mounting surface 216 around the airflow opening 192. Fasteners 220 can extend through openings in the alternator adapter mounting surface 216 and the adapter support plate 218 to mount the alternator adapter 136 to a fan back plate 221 coupled to the crankcase 184. The adapter support plate 218 is shown having three openings 222 for the fasteners 220 with one opening located in a tab 224 extending outward beyond the fan cover 138. The back plate 221 may have mounting locations 226 each comprising a boss extending forward from the engine 134 and each having a threaded opening to receive a respective fastener 220 from the alternator adapter 136.

FIG. 3 also shows alternator adapter 136 that couples the alternator 132 to the engine 134. The alternator adapter 136 may include a main body or spacer section 228 comprising an airflow outlet 230 in a first end 232 of the main body 228, and an engine shaft opening 234 in a second end 236 of the main body 228 opposite the first end 232. An engine mount 238 may couple to the first end 232 of the main body 228 around the airflow outlet 230, such that the engine mount 238 comprises a cooling air opening 230 (i.e. airflow outlet) formed therein. An alternator mount 240 (i.e. generator mount) couples to the second end 236 of the main body 228 around the engine shaft opening 234. The engine shaft opening 234 of the generator mount 240 may align with the cooling air opening 230 of the engine mount 238 such that the alternator adapter 136 can accommodate one or more shafts extending therethrough from the engine 134 to the alternator 132. For instance, the crankshaft 170 may extend through the airflow opening 230 to drive an alternator shaft 242 extending through the engine shaft opening 234. The alternator adapter 136 may also include an inlet air duct 244 (i.e., engine air duct) extending from a side of the alternator adapter 136. The inlet air duct 244 may be in fluid communication with the airflow opening 230 to provide airflow to the engine cooling fan 140.

The alternator 132 may include a cylindrical outer casing 246 with a first end 248 having an alternator shaft 242 and a second end 250 having alternator cooling fan 252. The cylindrical outer casing 246 may include a rotor bearing carrier 254 adjacent the alternator cooling fan 252 at the second end 250. The rotor bearing carrier 254 may include a first set of projections 256 with openings to receive fasteners 258 mounting a fan guard 260 over the alternator cooling fan 252. The alternator cooling fan 252 can draw a stream of air axially through the alternator 132 to vents 262 in the fan guard 260 covering the fan. The vents 262 may comprise slots around a circumference of the fan guard 260. The rotor bearing carrier 254 may include a second set of projections 264 with openings to receive fasteners 266 mounting the alternator 132 to the alternator adapter 136. The rotor bearing carrier 254 may include a lower support 268, which may include a bottom portion 270 that rests on a vibration isolator 272. The lower support 268 may also include a hollow portion 274 above the bottom portion 270 to access a fastener 276 extending through the bottom portion 270 and the vibration isolator 272.

Figure 4:
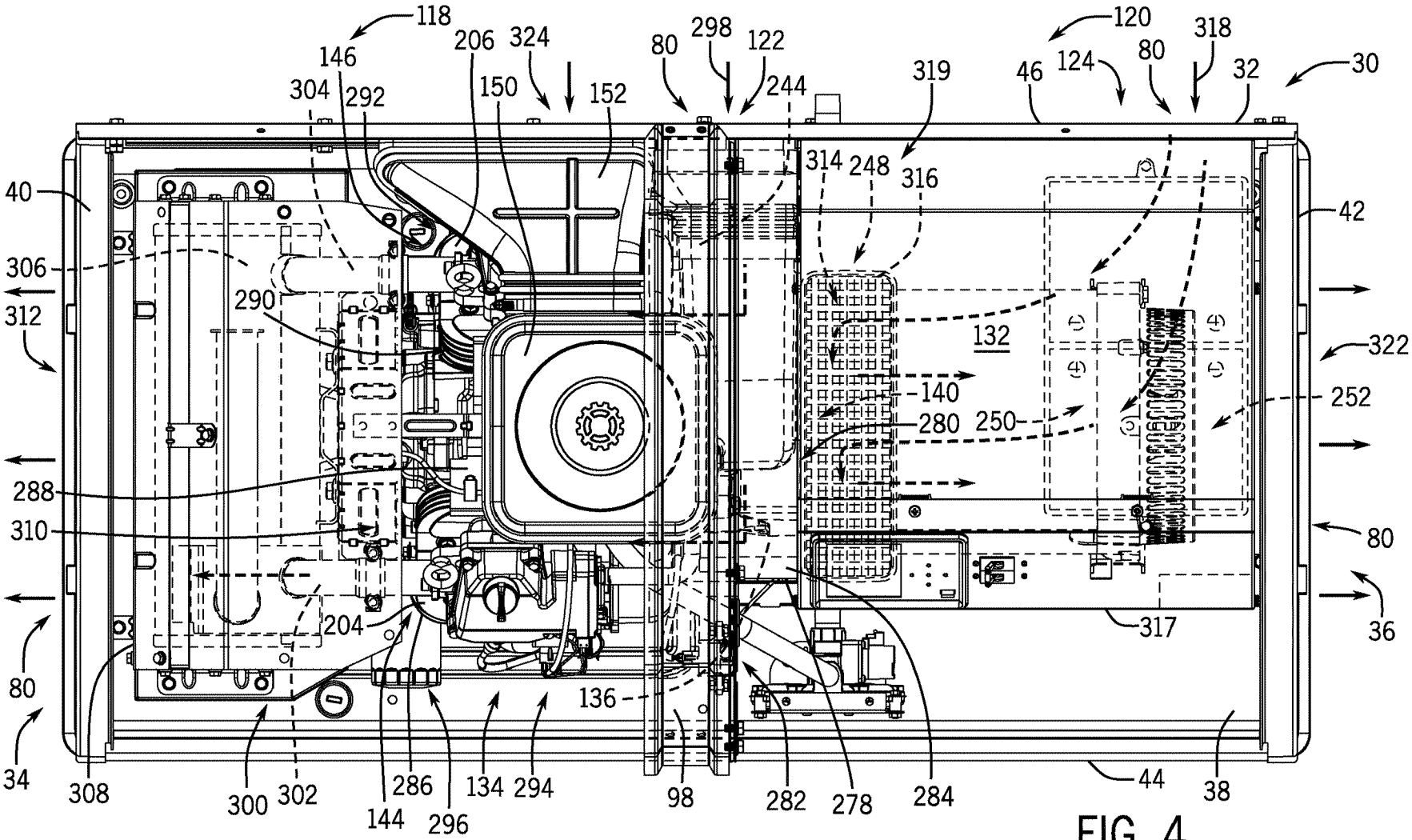
FIG. 4 is a top view of the electrical generator of FIG. 1 with left and right hoods hidden to expose the electrical generator components within, according to an embodiment of the invention.

Referring now to FIG. 4, a top view of the standby generator 30 looking into the enclosure 32 is shown, according to an embodiment of the invention. The standby generator 30 may include a partition wall 278 separating the enclosure 32 into at least two chambers 118, 120, with the engine 134 and the alternator 132 preferably mounted in separate chambers 118, 120. The partition wall 278 may extend from the support arm 98 to the base 38 of the enclosure 32, and also from the front wall 44 to the back wall 46 of the enclosure 32. The partition wall 278 may have an opening 280 through which the engine 134 mounted to the base 38 in the first chamber 118 can couple to drive the alternator 132 mounted to the base 38 in the second chamber 120. The partition wall 278 may comprise a main segment 282 aligned with the support arm 98 and an offset segment 284 spaced apart from the main segment 282 in a direction opposite the engine 134. The offset segment 284 provides clearance for air to flow between the engine 134 and the partition wall 278 from an airflow opening 122 in the back wall 46.

FIG. 4 shows the engine 134 mounted in a horizontal crankshaft orientation with the crankshaft driving the alternator 132 through the opening 280 in the partition wall 278. The engine 134 may comprise an air-cooled engine having an engine cooling fan 140 at a front portion of the engine facing the partition wall 278. The engine cooling fan 140 may draw a stream of air along the offset segment 284 of the partition wall 278 into the enclosure 32 through the airflow opening 122 in the back wall 46. An inlet air duct 244 (i.e., engine air duct) provided as part of the alternator adapter 136 may couple the engine 134 to one or more airflow openings 80 in fluid communication with the engine cooling fan 140. The engine cooling fan 140 may be positioned to draw cooling air through the air duct 244 coupling the air-cooled engine 134 to the air inlet 122 of the first chamber 118.

The engine cooling fan 140 preferably drives the stream of air over cylinders 144, 146 of the engine 134 in a direction toward the first end 34 of the enclosure 32. Each cylinder 144, 146 may comprise one or more air guides 286, 288 mounted over the plurality of cooling fins 204, 206. The cylinders 144, 146 may have inner surfaces 290 generally facing each other and outer surfaces 292 opposite the inner surfaces 290 with an inner air guide 288 mounted over each inner surface 290 and an outer air guide 286 mounted over each outer surface 292. The outer and inner air guide 286, 288 may each have a front portion 294 extending to a front side of the respective cylinders 144, 146 (engine fan side) and a back portion 296 extending to the back side of the respective cylinders 144, 146. The outer and inner air guides 286, 288 direct cooling air from a front side of the cylinders 144, 146 through the cooling fins 204, 206 to the back side of the cylinders 144, 146.

Accordingly, the engine cooling fan 140 may be driven by the engine 134 to force a first stream of cooling air 298 from the engine air duct 244 through the engine 134 in a direction opposite the alternator 132. The outer air guides 286 and the inner air guides 288 mount to the cylinders 144, 146 directing cooling air from the engine cooling fan 140 through the plurality of cooling fins 204, 206. Upon cooling the cylinders 144, 146, the cooling air can flow over an exhaust system 300 operatively coupled to the engine 134. The exhaust system 300 may comprise an exhaust pipe 302, 304 extending from each cylinder 144, 146 to a muffler 306 positioned in a muffler box 308. The muffler box 308 receives cooling air expelled from the engine 134 through an opening 310 into the muffler box 308 and cools the muffler 306 by directing the cooling air over the muffler 306. The muffler box 308 may also direct the cooling air out of the enclosure 32 through vents 312 in the first sidewall 40.

FIG. 4 also shows the alternator 132 driven by the engine 134 mounted in the enclosure 32 to produce electrical power for distribution from the standby generator 30. The alternator 132 may have a first end 248 coupled to the engine 134 and a second end 250 having an alternator cooling fan 252 on a side of the alternator 132 opposite the engine 134. The alternator cooling fan 252 can draw a stream of air into the alternator 132 through an inlet 314 located proximate the first end 248 and drive the stream of air in a direction toward the second end 36 of the enclosure 32. The inlet 314 may be located in a side of the alternator 132 between the first end 248 and the second end 250.

In one embodiment of the invention, an inlet air duct 316 formed in a side of the alternator 132 around the inlet 314 directs airflow into the alternator. The inlet air duct 316 may couple the alternator 132 to a generator control box 317 to provide cooling air flowing through the control box to the alternator. The control box 317 is shown coupled to an airflow opening 124 in the back wall 46 in fluid communication with the inlet air duct 316 coupled to the alternator 132. The inlet air duct 316 and the control box 317 may together form an alternator air duct 319 that couples the alternator 132 to an airflow opening 124 in the back wall 46 in fluid communication with the alternator cooling fan 252. The alternator cooling fan 252 may be driven by the alternator 132 to force a second stream of cooling air 318 from the alternator air duct 319 through the alternator 132 in a direction opposite the engine 134. The alternator cooling fan 252 draws cooling air axially through the alternator 132 from the alternator air duct 319 and can drive the cooling air out of the enclosure 32 through vents 322 in the second sidewall 42. In an alternative embodiment, the inlet air duct 316 optionally extends directly from the alternator 132 to an airflow opening in the back wall 46 and includes a boot (e.g. a rubber seal) coupling the air duct 316 to the airflow opening.

Accordingly, the standby generator 30 may include an engine air duct 244 and an alternator air duct 319 each coupled to at least one of the airflow openings 80, with the engine air duct 244 coupled to the engine 134 to provide a cooling air flow path from the respective airflow opening 80 to the engine cooling fan 140, and with the alternator air duct 319 coupled to the alternator 132 to provide a separate cooling air flow path from the respective airflow opening 80 to the alternator cooling fan 252. Each of the airflow openings 80 coupled to the engine air duct 244 and the alternator air duct 319 may be formed in a same enclosure wall 40, 42, 46, 44 of the generator enclosure 32. FIG. 4 shows the engine air duct 244 and the alternator air duct 319 coupled to one or more airflow openings 80 in the back wall 46 (i.e., openings/inlets 122, 124). FIG. 4 also shows an air filter 150 coupled to receive engine charge air from a third air duct 152 extending to an opening 324 in the back wall 46 of the enclosure 32. The three air ducts 244, 319, 152 provide a tri-flow arrangement within the enclosure 32.

Figure 5:
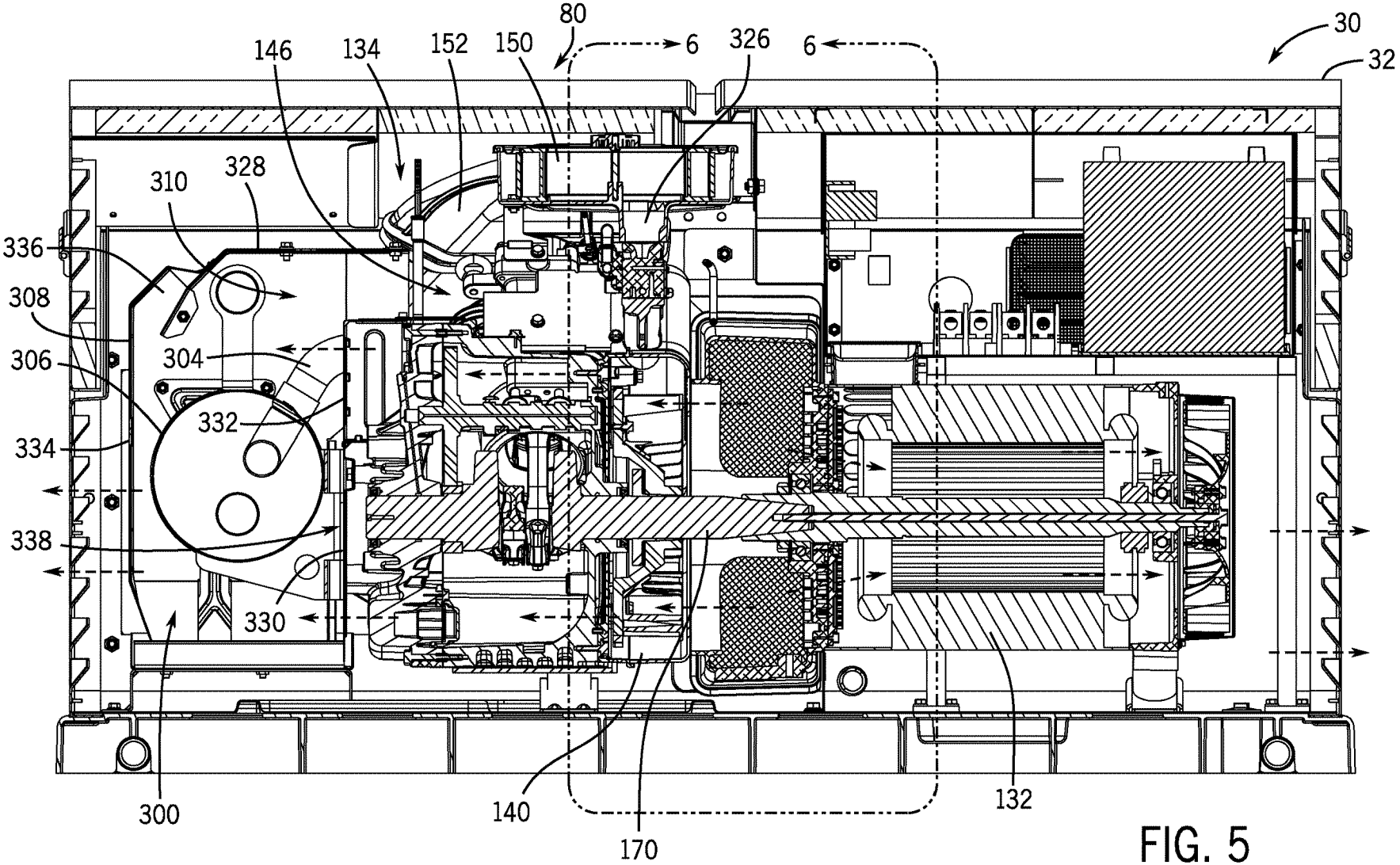
FIG. 5 is a cross-sectional view of the electrical generator of FIG. 1 taken vertically along a crankshaft of an engine driving an alternator, according to an embodiment of the invention.

Referring now to FIG. 5, a cross-section of the standby generator 30 taken axially through crankshaft 170 of the generator engine 134 is shown, according to an embodiment of the invention. In the embodiment of FIG. 5, the engine 134 includes a carburetor 326 that mixes air with a liquid fuel, e.g. gasoline, and supplies the mixture to cylinders 144 (FIG. 4), 146 of the engine 134. The carburetor 326 can be coupled to receive air from air filter 150 with combustion intake air duct 152 coupling the air filter to one or more airflow openings 80 in generator enclosure 32.

As shown in FIG. 5 and as previously described, the engine cooling fan 140 may be mounted to an upstream side of the engine 134, between the engine 134 and the alternator 132. The engine cooling fan 140 preferably drives cooling air through the air-cooled engine 134 in a direction opposite the alternator 132. The exhaust system 300 extends from the engine 134 in a direction downstream from the engine cooling fan 140 and in a direction opposite the alternator 132. The muffler 306 of the exhaust system 300 is at least partially enclosed in heat shield 308 (muffler box) that funnels cooling air expelled from the engine 134 over the muffler 306.

The muffler box 308 can surround the muffler 306 managing heat transfer from the muffler 306 within the enclosure 32. The muffler box 308 may include a plurality of heat shield panels 328, 330, 332, 334, 336. For instance, the muffler box 308 may include a top panel 328, a lower forward panel 330, an upper forward panel 332, a rearward panel 334, and two opposing side panels 336 between the forward and rearward panels 330, 332, 334. The lower forward panel 330 extends short of the top panel 328 creating the opening 310 into the muffler box 308. The exhaust pipes 302 (FIG. 4), 304 may extend through the opening 310 into the muffler box 308, with the opening 310 positioned in an airflow path downstream from the engine cooling fan 140.

The upper forward panel 332 extends from the lower forward panel 330 into a region between the exhaust pipes 302 (FIG. 4), 304, blocking heat transfer from an upper portion of the muffler 306 to the engine 134. The lower forward panel 330 and the upper forward panel 332 provide a heat shield 338 mounted between the muffler 306 and the engine 134. The upper forward panel 332 can allow cooling air expelled from the engine 134 to pass into the muffler box 308 since the upper forward panel 332 is preferably positioned between flow paths from the cylinders 144 (FIG. 4), 146. The muffler box 308 cools the muffler 306 with air received through the opening 310 into the muffler box.

Figure 6:
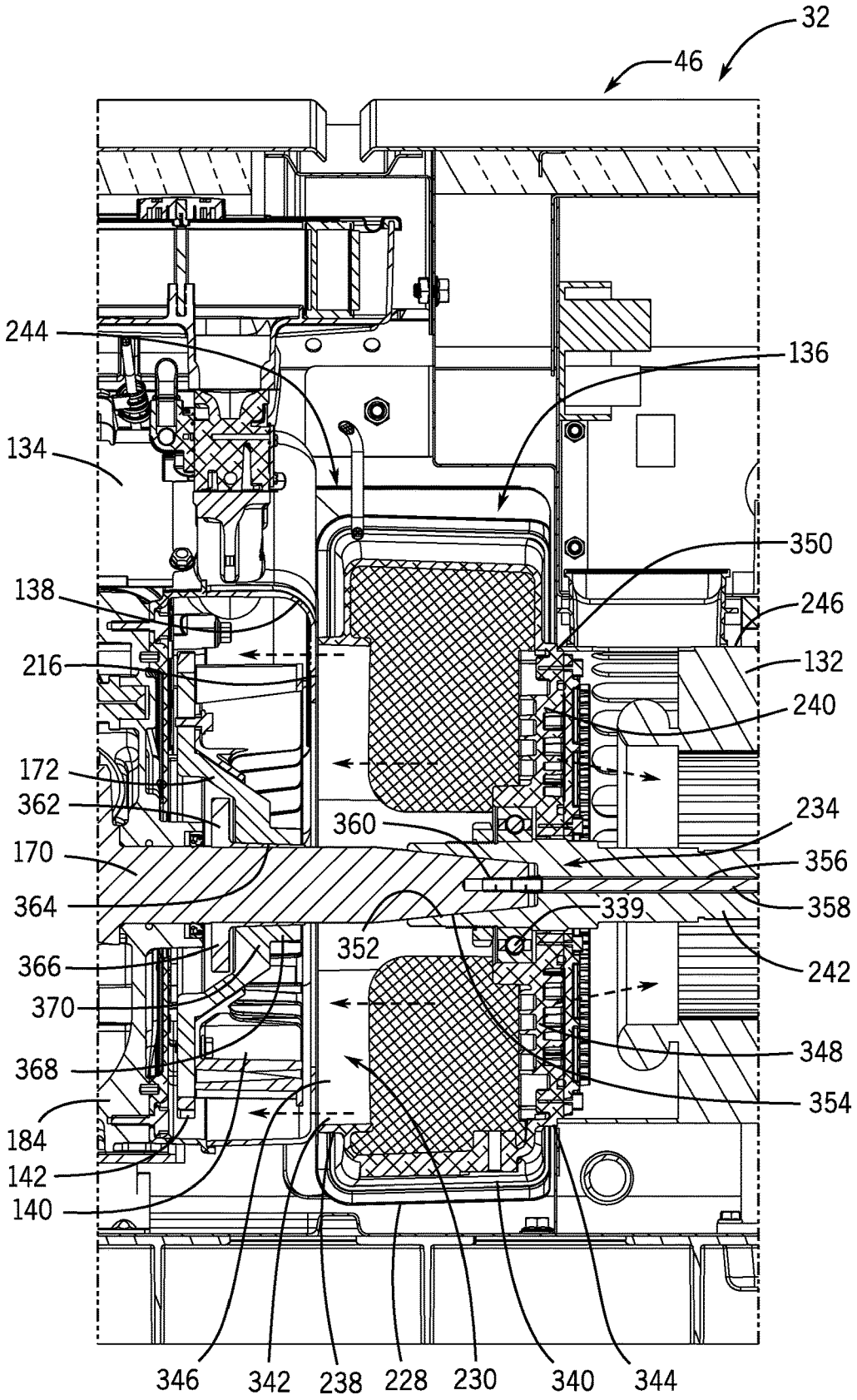
FIG. 6 is a detail view of the electrical generator of FIG. 5 taken along line 6-6 of FIG. 5 showing an alternator adapter coupling the alternator to the engine, according to an embodiment of the invention.

Referring now to FIG. 6, a detail view taken along line 6-6 of FIG. 5 shows the alternator adapter 136 coupling the alternator 132 to the engine 134, in accordance with an embodiment of the invention. As previously set forth, the alternator adapter 136 (i.e., generator coupling) preferably includes an engine mount 238 comprising an airflow opening 230, a generator mount 240 (i.e., alternator mount), and a main body or spacer section 228 holding the engine mount 238 aligned with the generator mount 240 in a spaced relationship allowing airflow into the coupling 136 and to the airflow opening 230. The air-cooled engine 134 may couple to the engine mount 238 such that the crankshaft 170 extends through the airflow opening 230, with an engine cooling fan 140 coupled to the crankshaft 170 on a side of the air-cooled engine 134 facing the coupling 136. The alternator 132 (i.e. generator) may couple to the generator mount 240 to be driven by the crankshaft 170, with the generator mount 240 comprising an opening 234 formed therein to receive the shaft 242 driving the alternator 132. The alternator adaptor 136 may include a bearing 339 within the generator mount 240 to receive the alternator shaft 242 and support the input end of the alternator 132.

According to one embodiment of the invention, the spacer section 228 comprises an outer enclosure 340 (i.e., outer casing) surrounding the crankshaft 170 extending from the engine mount 238 to the generator mount 240. The inlet air duct 244 extends outward from the outer enclosure 340 and in fluid communication with the airflow opening 230 in the engine mount 238. The inlet air duct 244 may extend from the outer enclosure 340 perpendicular to the crankshaft 170, and the inlet air duct 244 preferably extends to airflow opening 122 (FIG. 2) in the back wall 46 of the generator enclosure 32. The outer enclosure 340 and the generator mount 240 can provide an airflow path from the inlet air duct 244 to the airflow opening 230. The engine cooling fan 140 is shown positioned in a flow path from the airflow opening 230, so as to draw an airflow through the inlet air duct 244, into an interior volume of the spacer section 228, and out of the alternator adapter 136 through the airflow opening 230.

The alternator adapter 136 may have an engine mounting flange 342 and an alternator mounting flange 344 mounted as part of the respective engine mount 238 and generator mount 240. The engine mounting flange 342 may comprise an outlet casement 346 extending from an interior of the main body or spacer section 228 to mate against the alternator adapter mounting surface 216 of the fan cover 138. The outlet casement 346 may surround the airflow opening 230 such that the engine cooling fan 140 cools the engine 134 by drawing air through the outlet casement 346 in the engine mounting flange 342. The alternator mounting flange 344 may surround a chamber wall 348 of the alternator adapter 136 having the engine shaft opening 234 formed therein, the chamber wall 348 blocking airflow through the alternator mount 240. That is, the engine shaft opening 234 may be small to prevent substantial airflow through the alternator mount 240, thus preventing the alternator 132 and engine 134 from drawing air in opposite directions in the alternator adapter 136. The chamber wall 348 may comprise an indented circular ridge 350 around a perimeter edge to receive the cylindrical outer casing 246 of the alternator 132.

FIG. 6 also shows the crankshaft 170 coupled to the crankcase 184. The alternator 132 may be driven by the crankshaft 170 of the engine 134 on a side of the engine cooling fan 140 opposite the crankcase 184. The crankshaft 170 may have a tapered end 352 that fits into a tapered opening 354 in the alternator shaft 242. The alternator shaft 242 may have a bore 356 extending axially through the shaft for a fastener 358. The crankshaft 170 may have a corresponding bore 360 to receive the fastener 358 holding the alternator shaft 242 to the crankshaft 170. The bores 356, 360 in both shafts 242, 170 may be threaded, either right-handed or lefthanded according to the rotation of the crankshaft 170 to self-tighten the fastener 358.

The engine 134 may include a bushing 362 coupled around the crankshaft 170. The bushing 362 may have an "L" shaped cross-section that encircles the crankshaft 170 forming a cylindrical component 364 and a flat component 366. The fan base 142 couples to the bushing 362 mounted to the crankshaft 170 with a cylindrical component 368 of the fan base 142 surrounding the cylindrical component 364 of the bushing 362, and a flat component 370 of the fan base 142 fastened to the flat component 366 of the bushing 362. The domed shape component 172 of the fan base 142 extends over the flat component 366 of the bushing 362 allowing the engine cooling fan 140 to be mounted proximate the crankcase 184.

Figure 7A:
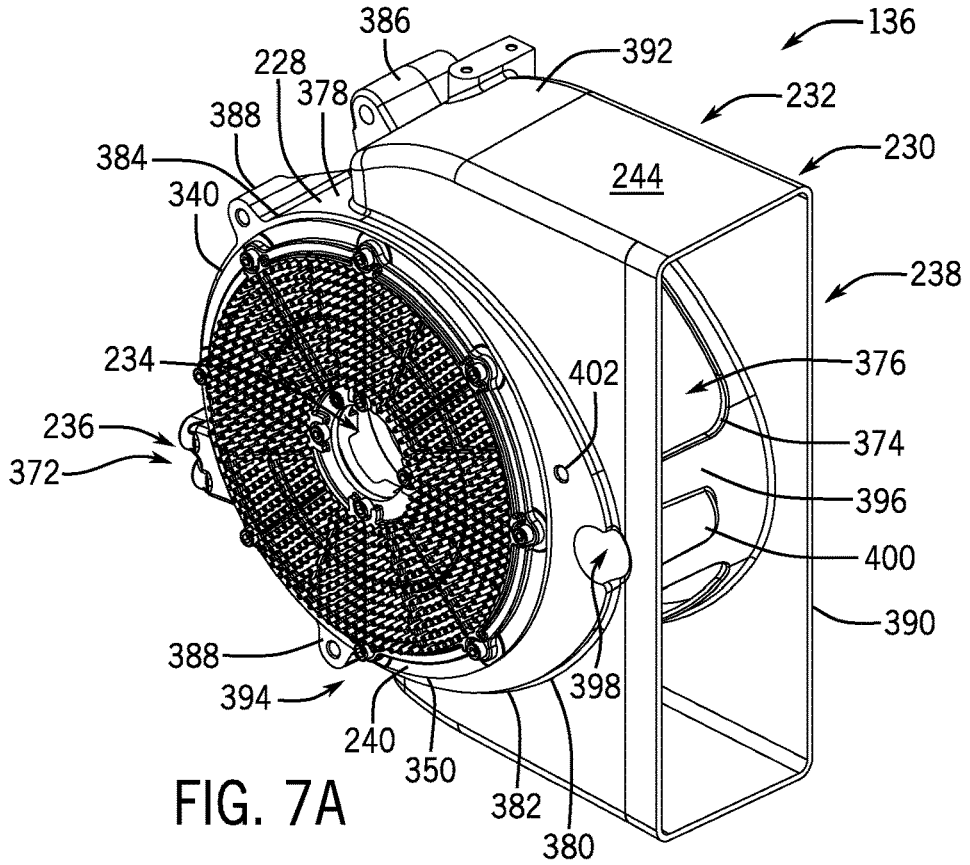
FIG. 7A is a perspective view of the alternator adapter of FIG. 6 showing a side of the adapter having an alternator mount, according to an embodiment of the invention.
Figure 7B:
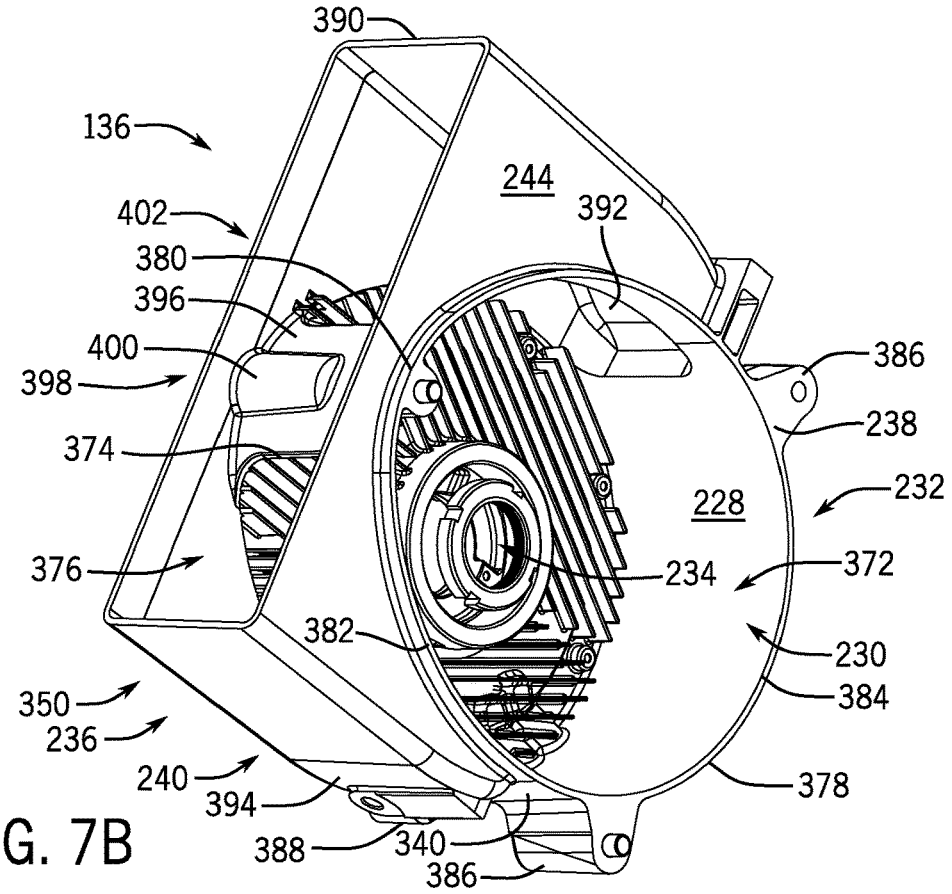
FIG. 7B is a perspective view of the alternator adapter of FIG. 6 showing a side of the adapter having an engine mount, according to an embodiment of the invention.

Referring now to FIGS. 7A and 7B, alternator adapter 136 is illustrated to show main body 228 defining an airflow chamber 372, according to an embodiment of the invention. The main body 228 may comprise a frame 374 with an outer casing 340 holding the engine mount 238 aligned with the generator mount 240, the outer casing 340 shown with an airflow inlet 376 fluidically connected to the cooling air opening 230 of the engine mount 238 to allow flow of engine cooling air through the alternator adapter 136. The outer casing 340 preferably extends from the engine mount 238 to the generator mount 240.

In an exemplary embodiment, the main body 228 may comprise a cylindrical outer casing 378 holding the engine mount 238 and the alternator mount 240 at opposite ends of the cylindrical outer casing 378, the engine mount 238 aligned with the engine shaft opening 234 of the generator mount 240. The airflow inlet 376 may be formed in the cylindrical outer casing 378 at a location between the first end 232 and the second end 236, and the airflow inlet 376 may be perpendicular to the airflow outlet 230. The cylindrical outer casing 378 may comprise an oblong cylindrical outer casing 380 with the alternator mount 240 at one end of the oblong cylindrical outer casing 380 having a circular outer ridge 350 to receive the alternator 132 (FIG. 6). The oblong cylindrical outer casing 380 is shown with an oblong cylinder portion 382 coupled to the engine air duct 244 and a cylinder portion 384 opposite the engine air duct 244. The oblong cylindrical outer casing 380 may define the cooling air opening 230 in the engine mount 238 such that the cooling air opening 230 can have a cross-sectional area larger than an opposing cross-sectional area of the alternator mount 240. In some embodiments of the invention, the alternator adapter 136 may accommodate an engine cooling fan positioned within the cooling air opening 230 or inside the main body 228.

To mount the alternator adapter 136, a plurality of engine mounting projections 386 may extend outward from the engine mount 238, and a plurality of alternator mounting projections 388 may extend outward from the alternator mount 240. The plurality of engine mounting projections 386 may include openings that receive fasteners 220 (FIG. 3) coupling the engine to the alternator adapter 136, and the plurality of alternator mounting projections 388 may include openings that receive fasteners 266 (FIG. 3) coupling the alternator to the alternator adapter 136. For improved access to the fasteners 220, 266 (FIG. 3), each of the plurality of engine mounting projections 386 can be angularly offset from each of the plurality of alternator mounting projections 388 in a circumferential direction around the adapter cylinder 378.

The frame 374 may comprise the cylinder 378 having the inlet air duct 244 extending outward from a side of the cylinder. That is, the inlet air duct 244 couples to the airflow inlet 376 and may extend outward from the outer casing 340/cylindrical outer casing 378 of the main body 228. The inlet air duct 244 can have a generally rectangular cross-section 390 with a width approximately equal to the length of the adapter cylinder 378, and a length slightly larger than a diameter of the adapter cylinder 378. The inlet air duct 244 can extend across a center of the adapter cylinder 378 with a pair of opposing side surfaces 392, 394 curving into the adapter cylinder 378.

FIGS. 7A and 7B also show a support arm or support member 396 extending across an interior of the inlet air duct 244 from the alternator mount 240 to the engine mount 238 with an opening 398 for a fastener 220 (FIG. 3) to couple the generator engine. That is, the support arm 396 can hold the engine mount 238 apart from the generator mount 240 and may have a first fastening receptacle 400 to couple the air-cooled engine to the coupling 136 (i.e. alternator adapter). In one embodiment of the invention, the support arm 396 may support a second fastening receptacle 402 with an opening into the inlet air duct 244 for a fastener 266 (FIG. 3) that couples the alternator to the alternator adapter 136, the second fastening receptacle 402 offset from the first fastening receptacle 400 coupling the generator engine.

Beneficially, embodiments of the invention provide an alternator adapter that mounts upstream from an air-cooled engine such that an engine cooling fan may be positioned between the alternator and the engine. The alternator adapter has a main body with an air inlet and an air outlet to provide airflow through the adapter to the engine cooling fan. An engine mount can surround the air outlet and an alternator mount can surround an engine shaft opening preferably aligned with the air outlet. The engine cooling fan may be coupled to a crankshaft of the engine extending through the airflow outlet to draw a stream of cooling air from the air inlet through the air outlet to the engine. The alternator may have an alternator fan that draws air through the alternator in a direction opposite the engine. Accordingly, the alternator adapter allows the engine cooling fan to face a direction opposite the alternator to provide opposing airflow paths through the engine and the alternator.

Therefore, according to one embodiment of the invention, an alternator adapter for a generator engine includes a main body defining an airflow chamber. The main body includes an airflow outlet in a first end of the main body, an engine shaft opening in a second end of the main body opposite the first end, and an airflow inlet between the first end and the second end. The alternator adaptor also includes an engine mount coupled to the first end of the main body around the airflow outlet and aligned with the engine shaft opening, and an alternator mount coupled to the second end of the main body around the engine shaft opening.

According to another embodiment of the invention, an engine-generator set includes a coupling for a generator having an engine mount comprising an airflow opening, a generator mount, and a spacer section holding the engine mount aligned with the generator mount in a spaced relationship allowing airflow into the coupling and to the airflow opening. The engine-generator set also includes an air-cooled engine coupled to the engine mount with a crankshaft extending through the airflow opening and an engine fan coupled to the crankshaft on a side of the air-cooled engine facing the coupling. The engine-generator set further includes a generator coupled to the generator mount and driven by the crankshaft.

According to yet another embodiment of the invention, an alternator adapter for an air-cooled engine includes an engine mount having a cooling air opening formed therein, a generator mount, and a frame having an outer casing holding the engine mount aligned with the generator mount. The outer casing includes an airflow inlet fluidically connected to the cooling air opening to allow flow of engine cooling air through the adapter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An alternator adapter for a generator engine comprising:

a main body defining an airflow chamber, the main body comprising:

an airflow outlet in a first end of the main body, an engine shaft opening in a second end of the main body opposite the first end, and an airflow inlet between the first end and the second end;

an engine mount coupled to the first end of the main body around the airflow outlet, the engine mount aligned with the engine shaft opening; and an alternator mount coupled to the second end of the main body around the engine shaft opening.

2. The alternator adapter of claim 1 further comprising a plurality of engine mounting projections extending outward from the engine mount, and a plurality of alternator mounting projections extending outward from the alternator mount; and wherein each of the plurality of engine mounting projections are angularly offset from each of the plurality of alternator mounting projections.

3. The alternator adapter of claim 1 wherein the alternator mount surrounds a chamber wall having the engine shaft opening formed therein, the chamber wall blocking airflow through the alternator mount.

4. The alternator adapter of claim 3 wherein the airflow inlet is perpendicular to the airflow outlet and is positioned between the chamber wall and the airflow outlet.

5. The alternator adapter of claim 1 further comprising an inlet air duct coupled to the airflow inlet and extending outward from the main body.

6. The alternator adapter of claim 5 further comprising a support member extending across an interior of the inlet air duct from the alternator mount to the engine mount with an opening for a fastener to couple the generator engine.

7. The alternator adapter of claim 5 wherein the main body comprises a cylindrical outer casing holding the engine mount and the alternator mount at opposite ends of the cylindrical outer casing, and wherein the inlet air duct comprises a generally rectangular shape having a pair of opposing sides curving into the cylindrical outer casing.

8. The alternator adapter of claim 7 wherein the airflow inlet is formed in the cylindrical outer casing at a location between the first and second ends, with the airflow inlet being perpendicular to the airflow outlet.

9. The alternator adapter of claim 7 wherein the cylindrical outer casing comprises an oblong cylindrical outer casing, and the alternator mount comprises a circular outer ridge to receive an alternator housing.

10. An engine-generator set comprising:

a coupling for a generator comprising:

an engine mount comprising an airflow opening, a generator mount, and a spacer section holding the engine mount aligned with the generator mount in a spaced relationship allowing airflow into the coupling and to the airflow opening; and an air-cooled engine coupled to the engine mount, the air-cooled engine comprising:

a crankshaft extending through the airflow opening, and an engine fan coupled to the crankshaft on a side of the air-cooled engine facing the coupling; and a generator coupled to the generator mount outside of the spacer section and driven by the crankshaft, the generator comprising a generator drive shaft that extends through an opening formed in the generator mount to couple with the crankshaft within an interior volume of the coupling.

11. The engine-generator set of claim 10 wherein the spacer section comprises:

an outer enclosure surrounding the crankshaft extending from the engine mount to the generator mount, and an inlet air duct extending outward from the outer enclosure and in fluid communication with the airflow opening.

12. The engine-generator set of claim 11 wherein the outer enclosure and the generator mount provide an airflow path from the inlet air duct to the airflow opening.

13. The engine-generator set of claim 11 wherein the inlet air duct extends from the outer enclosure perpendicular to the crankshaft.

14. The engine-generator set of claim 13 further comprising a support arm extending across an interior of the inlet air duct, the support arm having a fastening receptacle to couple the air-cooled engine to the coupling.

15. The engine-generator set of claim 11 wherein the engine fan is positioned in a flow path from the airflow opening, so as to draw an airflow through the inlet air duct, into an interior volume of the spacer section, and out through the airflow opening.

16. The engine-generator set of claim 15 wherein the air-cooled engine comprises a v-twin engine having two cylinders; and further comprising an engine fan cover mounted over the engine fan to direct cooling air from the engine fan over the two cylinders.

17. An alternator adapter for an air-cooled engine comprising: an engine mount comprising a cooling air opening formed therein; a generator mount; and a frame comprising an outer casing holding the engine mount aligned with the generator mount, the outer casing comprising an airflow inlet fluidically connected to the cooling air opening to allow flow of engine cooling air through the adapter wherein the generator mount comprises an adapter wall having an engine shaft opening formed therein aligned with the cooling air opening, the adapter wall blocking airflow through the generator mount, and wherein the airflow inlet is perpendicular to the cooling air opening and is positioned between the adapter wall and the cooling air opening.

18. The alternator adapter of claim 17 wherein the outer casing extends from the engine mount to the generator mount.

19. The alternator adapter of claim 18 further comprising an inlet air duct coupled to the airflow inlet and extending outward from the outer casing.

20. The alternator adapter of claim 19 wherein the frame comprises a cylinder having the inlet air duct extending outward from a side of the cylinder.

21. The alternator adapter of claim 17 wherein the cooling air opening has a cross-sectional area larger than an opposing cross-sectional area of the generator mount.

* * * * *